US005975947A

United States Patent [19]

Wu et al.

[11] Patent Number: 5,975,947

[45] Date of Patent: Nov. 2, 1999

[54] ELECTRICAL CONNECTOR FIXING DEVICE AND CONNECTOR INCLUDING THE DEVICE

[75] Inventors: Jerry Wu, Chang-Hua Hsien, Taiwan; Joseph Tang, San Jose, Calif.

[73] Assignee: Hon Hai Precision Ind. Co., Ltd., Taipei Hsien, Taiwan

[21] Appl. No.: 08/962,186

[22] Filed: Oct. 31, 1997

[51] Int. Cl.[6] ..... H01R 13/73

[52] U.S. Cl. ..... 439/567

[58] Field of Search ..... 439/567, 157, 439/160, 571–573

[56] References Cited

U.S. PATENT DOCUMENTS 5,192,228 3/1993 Collins et al. ..... 439/567
5,387,115 2/1995 Kozel et al. ..... 439/567
5,393,247 2/1995 DiOrazio et al. ..... 439/567

*Primary Examiner*—Gary F. Paumen

[57] ABSTRACT

A connector fixing device and a connector including the fixing device are disclosed. The fixing device is formed by stamping a metal plate to have a base, a pair of fixing legs extending downward from the base for engaging with a mother board, and two fitting wings extending upward from two sides of the base and cooperating therewith to define a middle depression in an upper part of the fixing device. The two fitting wings interferentially fit into two grooves defined by two projection portions of a housing of the connector. The two projection portions are located at a bottom part of the housing beside a space defined by the housing which receives a foot portion of a card ejector. The card ejector is pivotably connected to the housing for ejecting an inserted electrical card. The middle depression of the fixing device is defined below the space receiving the foot portion of the card ejector.

11 Claims, 4 Drawing Sheets

ELECTRICAL CONNECTOR FIXING DEVICE AND CONNECTOR INCLUDING THE DEVICE

BACKGROUND OF THE INVENTION

1. Field of The Invention

The present invention relates to a device (particularly a metal hold-down) for fixing an electrical connector to a mother board, and a connector particularly a card edge connector with an ejector) including the connector fixing device.

2. The Prior Art

In order to fix an electrical connector to a mother board, a fixing device (also called board lock) was previously disclosed consisting of mounting posts integrally molded with a dielectric housing of the connector. When mounting the connector to the mother board, the posts are extended through corresponding holes in the mother board to interferentially engage therewith. However, such mounting posts do not securely engage with the mother board which may cause the connector to become loosened from the mother board while being subject to a reflow process for soldering the connector to the mother board. Furthermore, since the mounting posts are formed by plastic molding, they are not durable. Such designs integrally forming mounting posts with the housing of the connector are disclosed in Taiwan Patent Application Nos. 80204998, 81212698, 81211344, 83200853 and 83205670.

To overcome the above-mentioned disadvantages, a fixing device formed by stamping a metal plate and commonly referred to as metal hold-down was later introduced. The metal hold-down has an upper portion fixed to the housing of the connector and a lower portion interferentially engaging with the mother board, thereby fixing the connector to the mother board. The locking effectiveness of the metal hold-down and the durability thereof are better than the mounting posts integrally formed with the housing of the connector. Prior art concerning the metal hold-down are disclosed in Taiwan Patent Application Nos. 80207178, 80202099, 80213095, 81205296, 81901507, 81213628, 81212824, 81211189, 82204413, 83207736, 82107923 and 83106349.

However, for a card edge connector, particularly a DIMM (Dual Inline Memory Module) connector with a card ejector, the housing thereof can only accommodate the metal hold-down if the length of the housing is increased, which opposes the trend of modern computer technology toward increasingly compact components.

Hence, a durable connector fixing device having adequate attachment capabilities is required for mounting to a connector without the necessity of increasing the length of the housing of the connector thereby eliminating the above-mentioned defects of current devices for fixing a connector to a mother board.

SUMMARY OF THE INVENTION

Accordingly, an objective of the present invention is to provide an electrical connector fixing device, particularly a metal hold-down made by stamping a metal plate. The metal hold-down can be mounted to a housing of a card edge connector having a card ejector without the necessity of increasing the length of the housing to accommodate the fixing device and without interfering wits a pivotal movement of the card ejector ejecting an inserted electrical card from the connector.

To fulfill the above-mentioned objective, a connector fixing device according to an embodiment of the present invention is formed by stamping a metal plate to have a flat configuration. The fixing device comprises a base, two legs extending downward from a middle portion of the base, two fitting wings extending upward from two sides of the base and cooperating therewith to define a rectangular middle depression in an upper portion of the fixing device. A connector has an elongated housing defining a central slot for receiving an inserted electrical card and an ejector receiving space in a lengthwise end of the housing. A number of contacts are received in the central slot. A pair of plate springs are mounted to the housing between the central slot and the ejector receiving space. A card ejector has a body pivotably connected to the lengthwise end of the housing, a foot received in the ejector receiving space and a kicker located below the plate springs. The connector fixing device is securely mounted to a bottom of the housing, wherein the middle depression thereof is defined below the ejector receiving space so that when the ejector is pivoted relative to the housing, the fixing device does not interfere with the movement of the ejector. The two legs of the connector fixing device extend through the mother board to fixedly engage therewith, thereby securely fixing the connector to the mother board.

DETAILED DESCRIPTION OF THE PREFERRED EMBODIMENTS

Reference will now be made in detail to the preferred embodiment of the present invention.

Figure 1:
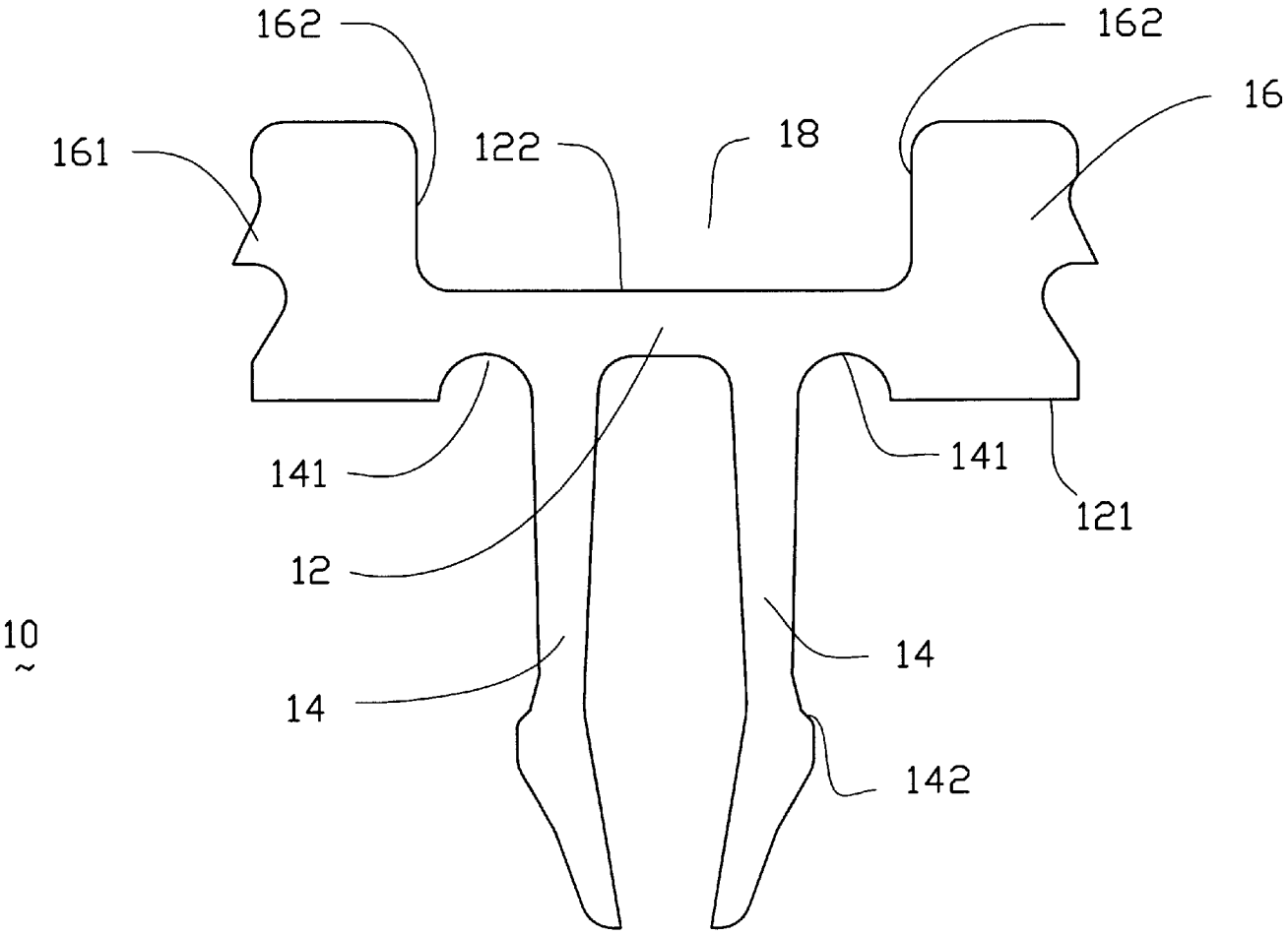
FIG. 1 is a plane view showing a connector fixing device in accordance with the present invention.
Figure 2:
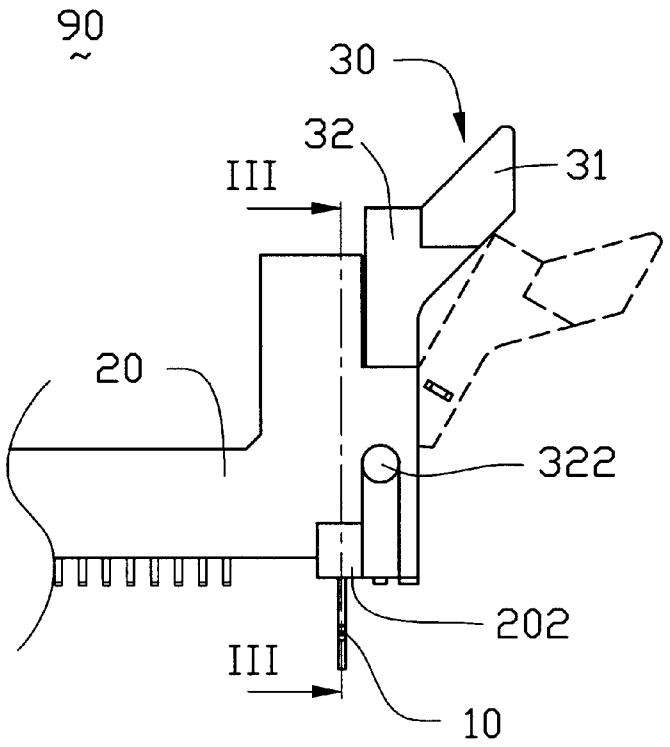
FIG. 2(A) is a front view showing a portion of a DIMM connector equipped with a card ejector and the card fixing device of FIG. 1.
FIG. 2(B) is a top view of the connector of FIG. 2(A)
Figure 2:
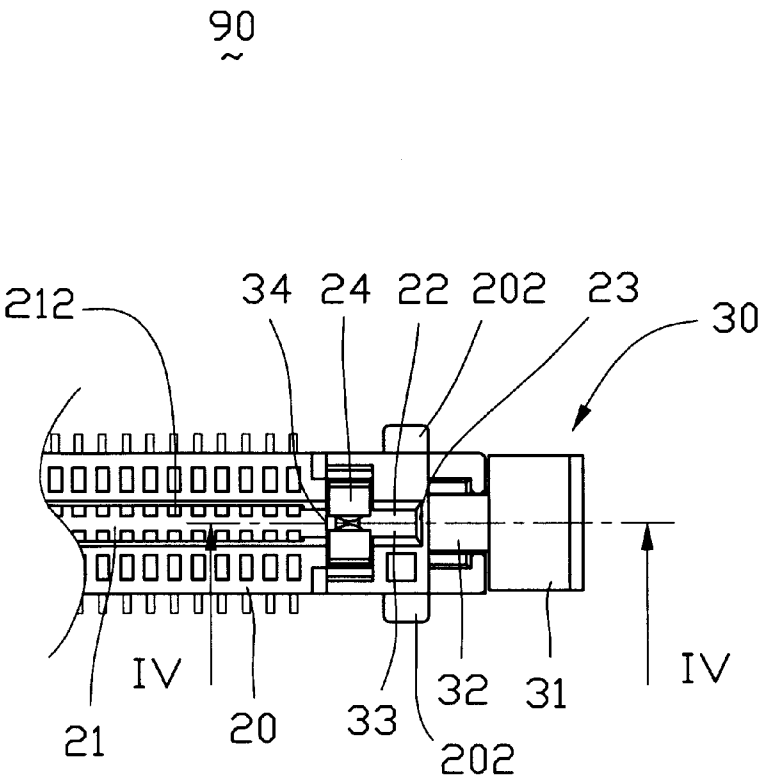

Referring to FIG. 1, a connector fixing device 10 in accordance with the present invention is formed by stamping a metal plate and is commonly termed a "metal hold-down". The connector fixing device 10 has a flat configuration with a substantially uniform thickness and forms a base 12 having an upper side 122 and a lower side 121. Two board engaging legs 14 extend downward from the lower side 121 of the base 12 and are spaced apart a distance. Each engaging leg 14 is formed with a side protrusion 142 extending in opposite directions. The side protrusions 142 engage with a printed circuit board (PCB, not shown) when the legs 14 are extended through a hole defined in the PCB thereby fixedly connecting the fixing device 10 to the PCB. Two recesses 141 are defined in the base 12 adjacent to the legs 14, respectively. Each recess 141 has a semicircular shape and an opening exposed to the lower side 121 of the base 12. Due to the provision of the recesses 141, the legs 14 are more resilient and can be easily deformed for insertion into the hole defined by the PCB. Two fitting wings 16 extend upward from two lateral sides of the base 12, respectively. Each fitting wing 16 has an inner side 162 cooperating with the upper side 122 of the base 12 thereby defining a rectangular middle depression 18 in an upper part of the connector fixing device 10. Furthermore, each fitting wing 16 forms a tooth 161 on an outer side thereof. Said teeth 161 are used to interferentially engage with a housing of a connector to secure the fixing device 10 to the connector. In the present invention, since the fixing device 10 defines a middle depression 18 in an upper part thereof, it can be mounted to the housing of the connector below an ejector of the connector without interfering with a pivotable moment of the ejector. Thus, an increase in the length of the housing is not necessary to mount the fixing device. Further descriptions concerning this are made with reference to FIGS. 2(A) to 4.

FIG. 2(A) shows a front view of a DIMM connector 90 having a housing 20, an ejector 30 having a body portion 32 with an axis 322 pivotably connected to the housing 20 and the connector fixing device 10 fixed to a pair of projection portions 202 of the housing 20. The projection portions 202 are located at a bottom of the housing near a foot portion 33 (best seen in FIG. 4) of the ejector 30. The ejector 30 further has a handle portion 31 for receiving a force causing the ejector to pivot (as shown by the phantom lines) relative to the housing 20.

FIG. 2(B) shows a top view of the DIMM connector 90 of FIG. 2(A), wherein the housing 20 thereof further has a central slot 21 defined therein for receiving a number of contacts 212 for electrically connecting with an electrical card (not shown) inserted into the connector 90, a card alignment wall 23 formed thereon for guiding the electrical card into the connector 90 and a space 22 defined beside the alignment wall 23 for receiving the foot portion 33 of the ejector 30 and a side portion of the inserted electrical card. The foot portion 33 is connected with the body portion 32 and extends toward the central slot 21. A pair of plate springs 24 are attached to the housing 20 between the central slot 21 and the space 22. Said springs 24 clamp the inserted electrical card thereby firmly fixing it in position. The ejector 30 further has a card kicker 34 extending from the foot portion 33 toward the central slot 21 below the springs 24 (best seen in FIG. 4).

Figure 3:
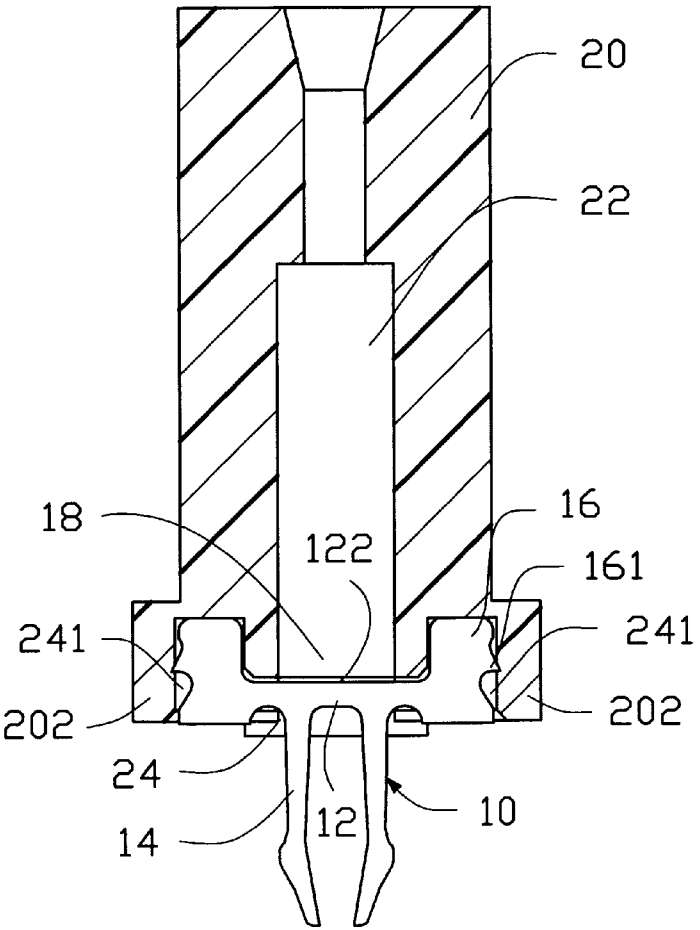
FIG. 3 is a cross-sectional view of the connector taken along line III—III of FIG. 2(A), with the ejector removed.

Referring to FIG. 3, the housing 20 further defines a recess 24 below the space 22. Each projection portion 202 defines a groove 241 beside the space 22 and in communication therewith via the recess 24. To mount the fixing device 10 to the housing 20, the two fitting wings 16 are brought to extend into the two grooves 241 from the bottom of the housing 20 until top edges of the side wings 16 and the upper side 122 of the base 12 abut the housing 20, and the teeth 161 are interferentially engaged with the projection portions 202 thereby securely mounting the fixing device 10 to the housing 20. When the fixing device 12 is fixedly mounted to the housing 20, the base 12 is received in the recess 24, the legs 14 extend downward from the bottom of the housing 20, and the rectangular depression 18 is located below the space 22.

Figure 4:
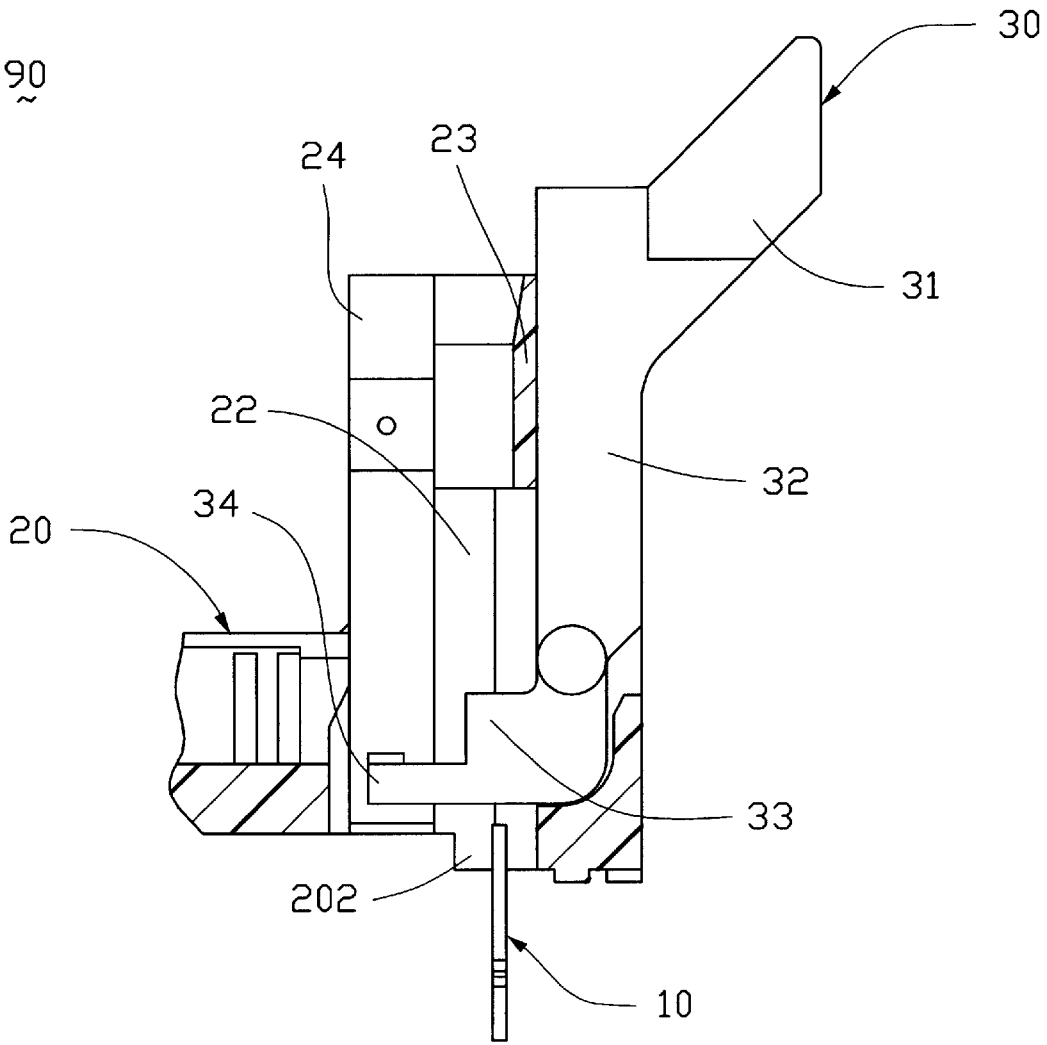
FIG. 4 is a cross-sectional view of the connector taken along line IV—IV of FIG. 2(B).

Also referring to FIG. 4, by the design of the present invention, wherein the connector fixing device 10 defines a middle depression 18 in an upper part thereof and two fitting wings 16 extending into two grooves 241 at a bottom of a housing 20 beside a space 22 receiving a foot portion 33 of a card ejector 30, the connector fixing device 10 can be securely mounted to the housing 20 at a position below the foot portion 33 of the ejector 30 without the necessity of increasing the length of the housing 20 to accommodate the connector fixing device 10 and without the connector fixing device 10 interfering with the pivotal movement of the ejector 30 ejecting an inserted electrical card by a card kicker 34 thereof.

In accordance with the above descriptions, the connector fixing device 10 and the connector 90 have structures different from the prior art and can overcome the disadvantages thereof; thus, the present invention qualifies to be granted a patent.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

It is claimed that:

1. An electrical connector, comprising:

an elongated housing having a bottom for connection to a mother board, a central slot for receiving an electrical card and an ejector receiving space near a lengthwise end of the housing;

a number of contacts received in the central slot;

an ejector having a body pivotably connected to the housing, a foot portion connected with the body and extending toward the central slot and a card kicker connected with the foot portion and further extending toward the central slot, wherein the foot portion is received in the ejector receiving space; and a connector fixing device for fixing the connector to the mother board, said connector fixing device comprising:

an upper portion mounted to the bottom of the housing and having a middle depression below the ejector receiving space for receiving the foot portion therein; and a lower portion extending downward from the upper portion for fixedly engaging with the mother board.

2. The connector in accordance with claim 1, wherein the fixing device is formed by stamping a metal plate.

3. The connector in accordance with claim 2, wherein the device has a flat configuration.

4. The connector in accordance with claim 3, wherein the housing defines two grooves at the bottom thereof beside the ejector receiving space, and the upper portion of the device forms a base and two fitting wings extending upward from two sides of the base into the two grooves to interferentially engage with the housing, and the lower portion of the device forms a pair of legs extending downward from the base.

5. The connector in accordance with claim 4, wherein the middle depression is defined by the base and the two fitting wings.

6. The connector in accordance with claim 5, wherein each fitting wing comprises a tooth formed at a side opposite the middle depression.

7. The connector in accordance with claim 4, wherein the connector fixing device further has two recesses defined in the base adjacent to the legs, respectively.

8. The connector in accordance with claim 4, wherein each leg has a side protrusion extending in opposite directions.

9. The connector in accordance with claim 1 further comprising a pair of plate springs mounted to the housing between the central slot and the ejector receiving space, said springs clamping an inserted electrical card to fix it in position.

10. The connector in accordance with claim 9, wherein the card kicker is located below the plate springs.

11. An electrical connector comprising:

an elongated housing defining a central slot for receiving a card therein;

at least an ejector pivotably positioned adjacent to one end of the housing, said ejector including a foot portion with a kicker thereon for ejecting the card out of the connector;

at least a plate-like metal hold-down generally disposed below the ejector and perpendicular to the central slot wherein said hold-down includes a middle depression for receipt and passage of the foot portion of said ejector therein.

* * * * *